United States Patent [19]

Bussard

[11] Patent Number: 4,774,503

[45] Date of Patent: Sep. 27, 1988

[54] ANTI-THEFT TAG

[75] Inventor: Charles B. Bussard, Beavercreek, Ohio

[73] Assignee: Monarch Marking Systems, Inc., Dayton, Ohio

[21] Appl. No.: 64,711

[22] Filed: Jun. 22, 1987

[51] Int. Cl.[4] ..... G08B 13/18

[52] U.S. Cl. ..... 340/572; 24/150 P; 24/150 R; 340/693

[58] Field of Search ..... 340/572, 551, 693; 24/13, 356, 155 BB, 150 P, 150 R

[56] References Cited

U.S. PATENT DOCUMENTS

| | | | |
|---|---|---|---|
| 3,500,373 | 3/1970 | Minasy | 340/572 |
| 3,911,534 | 10/1975 | Martens et al. | 24/150 R |
| 3,942,829 | 3/1976 | Humble et al. | 292/316 |
| 3,973,418 | 8/1976 | Close | 70/34 |
| 4,104,622 | 8/1978 | Van Niel | 340/572 |
| 4,156,302 | 5/1979 | Van Niel | 24/155 RB |
| 4,311,992 | 1/1982 | De Chant | 340/572 |
| 4,339,853 | 7/1982 | Lipschitz | 24/155 BR |
| 4,502,717 | 3/1985 | Close | 292/316 |
| 4,603,453 | 8/1986 | Yokoyama | 24/155 R |

*Primary Examiner*—Glen R. Swann, III

*Attorney, Agent, or Firm*—Joseph J. Grass

[57] ABSTRACT

There is disclosed a tag for use in an electronic article surveillance system including a housing, a detectable marker held by the housing, and a releasable magnetic lock. The lock, which cannot be defeated by deflecting the housing, securely grips a pin by means of opposed jaws. The jaws and a pair of leaf springs are constructed of a single piece of sheet metal. Magnetic biasing of the sheet metal overcomes the forces exerted by the springs and causes the jaws to open to release the pin.

8 Claims, 2 Drawing Sheets

ANTI-THEFT TAG

BACKGROUND OF THE INVENTION

1. Field of the Invention

This invention relates to the art of anti-theft tags for electronic article surveillance systems.

2. Brief Description of the Prior Art

The following U.S. Pat. Nos. are made of record: 3,500,373; 3,911,534; 3,942,829; 3,973,418; 4,104,622; 4,156,302; 4,311,992; 4,339,853; and 4,502,717.

It is known to construct a resonant circuit for an article surveillance tag using a spiral winding in a single layer or plane which is known as a pancake or wafer design.

SUMMARY OF THE INVENTION

This invention relates to an improved anti-theft tag for an electronic article surveillance system. The tag of the invention includes an improved magnetic lock for releasably locking the tag to merchandise to be protected. The lock is inexpensively made and yet is magnetically releasable.

According to a specific embodiment of the invention, the tag includes a housing and a detectable marker held by the housing. The housing mounts a magnetic lock for holding the tag to an article to be protected, and the housing includes first and second spaced wall portions. The lock includes a pin and a flexible, resilient, magnetically deflectable sheet metal member disposed between the spaced wall portions of the housing and having a pair of opposed jaws, the first wall portion being next adjacent the article to be protected and at least the portion surrounding the lock being sufficiently rigid to prevent manual deflection of the sheet metal member from outside the housing. The jaws are movable to engage or disengage the pin selectively and the sheet metal member is biased so that the jaws engage the pin when the pin is inserted between the jaws. The jaws are positioned so that attempted withdrawal of the pin without prior movement of the jaws to the disengaged position will not release the pin. The lock includes magnetically responsive material to enable the jaws to be moved by magnetic attraction to a position disengaged from the pin. It is preferred that the sheet metal member includes a pair of plate portions having spaced side edges, with the plate portions being connected solely by a pair of spring portions disposed between side edges and outwardly of the jaws. It is most preferred that the sheet metal member include a pair of plate portions, and an auxiliary plate on each of the plate portions to enhance the magnetic response of the lock. Other features and advantages will be evident to those skilled in the art from the following detailed description.

DETAILED DESCRIPTION OF THE PREFERRED EMBODIMENT

Figure 1:
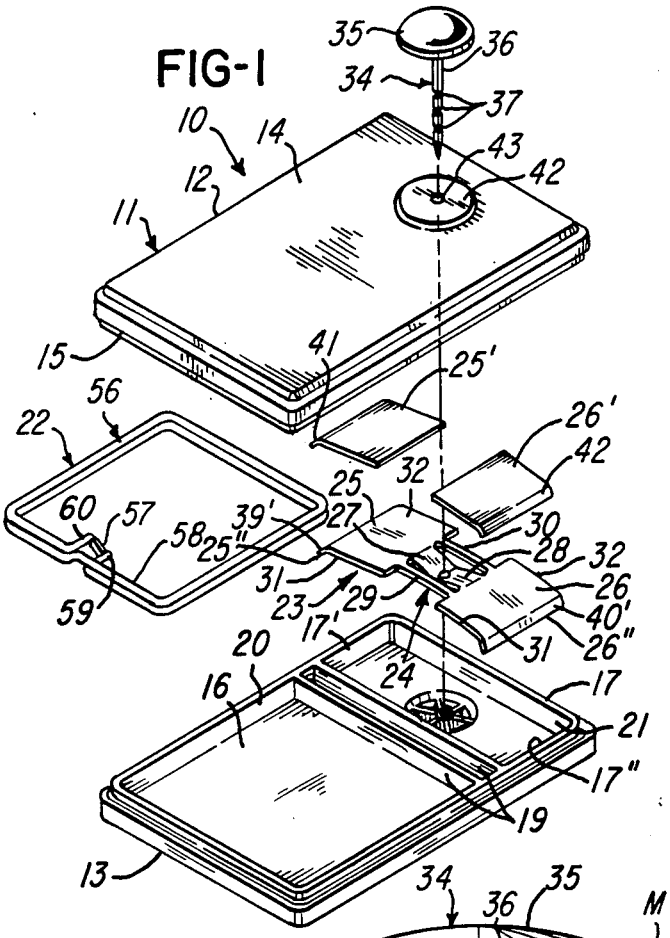
FIG. 1 is an exploded perspective view of a tag in accordance with the invention.
Figure 2:
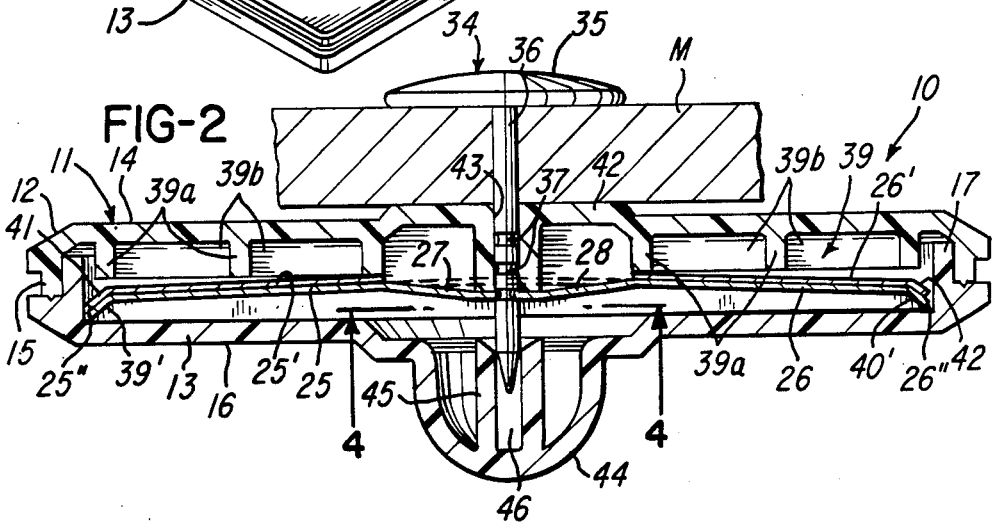
FIG. 2 is a sectional view through the tag at its lock, the lock being shown in the locked position.
Figure 3:
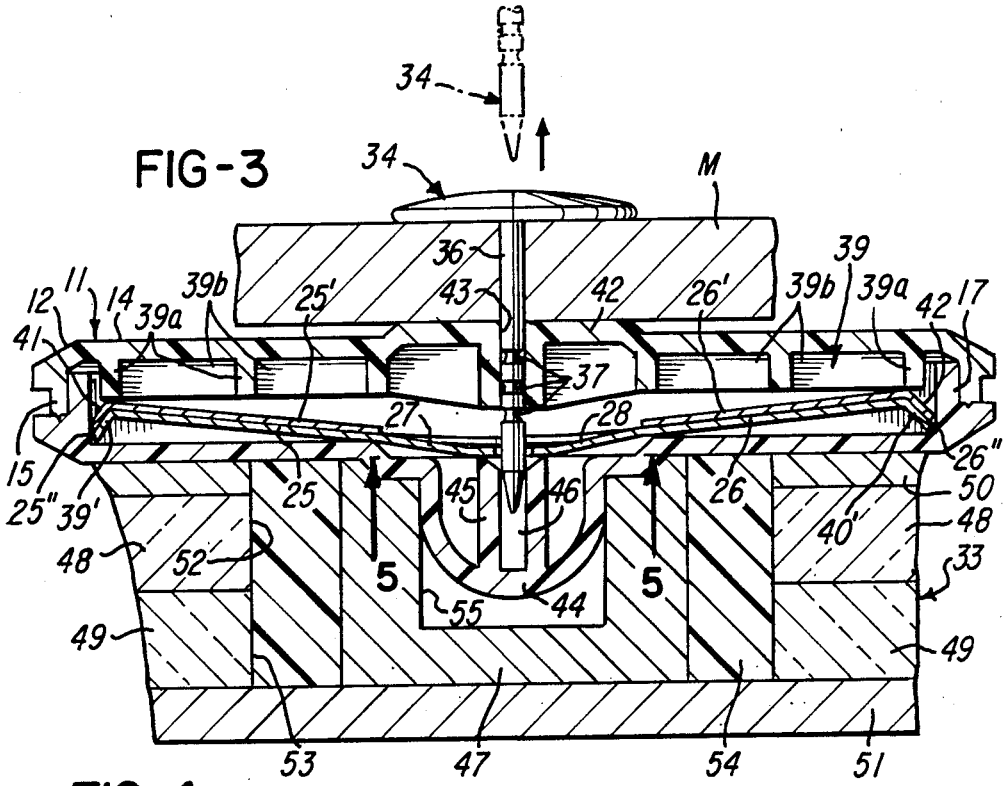
FIG. 3 is a sectional view similar to FIG. 2, with the lock being shown in the unlocked position, and showing additionally a fragmentary portion of a magnetic decoupler.

With reference to FIG. 1, there is shown a tag generally indicated at 10 for use in an electronic article surveillance system. The tag 10 includes a housing generally indicated at 11 comprised of a pair of housing or wall portions 12 and 13. The wall portion 12 has a generally planar portion 14 and a peripheral flange 15. The wall portion 13 has a generally planar portion 16 and a peripheral flange 17. The flanges 17 fit within the outline of the flange 15 as best shown in FIGS. 2 and 3. The wall portions 12 and 13 are preferably sealed either ultrasonicly or chemically adjacent the flanges 15 and 17 to permanently secure the wall portions 12 and 13 to each other to provide a unitary, permanently closed housing. The wall portion 13 has a transverse pair of ribs 19. The generally planar portions 12 and 13 are spaced apart to provide interior spaces or chambers 20 and 21. The chamber 20 houses a marker generally indicated at 22 and the chamber 21 houses components of a lock generally indicated at 23.

Figure 4:
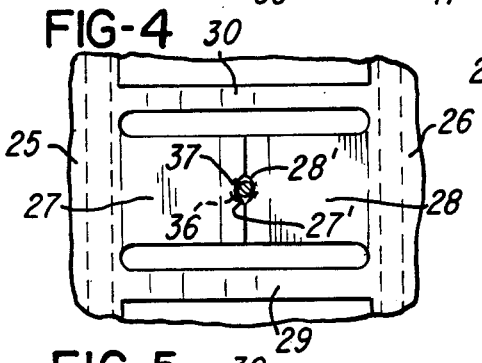
FIG. 4 is a sectional view taken generally along line 4—4 of FIG. 2.
Figure 5:
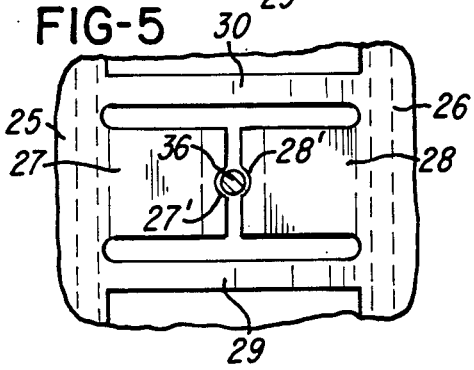
FIG. 5 is a sectional view taken generally along line 5—5 of FIG. 3.
Figure 6:
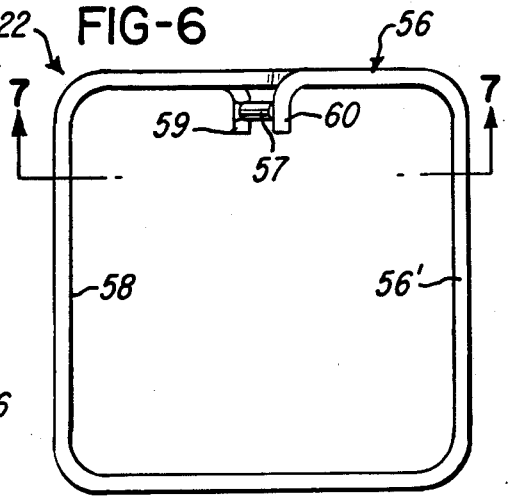
FIG. 6 is a top plan view of a marker also shown in FIG. 1.

The lock 23 includes a lock member generally indicated at 24 preferably stamped from a single piece of magnetizable material such as spring steel. The lock member 24 comprises a pair of plate portions 25 and 26, a pair of jaws 27 and 28, and a pair of flexible, resilient leaf springs or spring members 29 and 30. The plate portions 25 and 26 have spaced side edges 31 and 32. There are preferably two and only two leaf springs 29 and 30 which are flexible and resilient to deflect readily from the position shown in FIG. 2 to the position shown in FIG. 3 upon the tag 10 being brought into proximity with a magnetic decoupler generally indicated at 33 in FIG. 3, and yet the springs 29 and 30 exert enough force to return the lock member to its FIG. 2 position upon removal of the tag 10 from the decoupler 33. The springs 29 and 30 are disposed inwardly of the spaced planes of the side edges 31 and 32 and outwardly of the jaws 27 and 28 and are relatively narrow. The lock 23 also includes a pin 34 having a head 35 and a shank 36. The pin 34 also has axially spaced grooves 37 to receive the jaws 27 and 28. The jaws 27 and 28 have arcuate pin-engaging edges 27' and 28' as best shown in FIGS. 4 and 5. When the jaws 27 and 28 are in the locked position (FIG. 2) in any one of the grooves 37, the opening between the jaws 27 and 28 is less than the diameter of the shank 36 (FIG. 4), so that removal of the pin 35 is not possible; when the jaws 27 and 28 are in the unlocked position (FIG. 3) the opening between the jaws 27 and 28 is greater than the diameter of the shank 36 (FIG. 5) so that the shank 36 of the pin 35 can be inserted between the jaws 27 and 28 or withdrawn therefrom. If desired, the shank 36 can also be constructed without the grooves 37 or with very shallow small closely spaced ridges.

Although the lock 33 functions without auxiliary plates 25' and 26' which are composed of magnetizable material such as steel, they can be provided to enhance the magnetic attraction or force which the decoupler 33 exert on the lock 23. The plates 25' and 26' can be constructed out of the same sheet metal stock of which the lock member 24 is composed, if desired. The plates 25' and 26' are of generally the same configuration as the plate portions 25 and 26. The plate portions 25 and 26 preferably have flanges 39' and 40' and the plates 25' and 26' preferably have flanges 41 and 42. Terminal edges 25'' and 26'' of flanges 39' and 40' bear against the planar portion 16, as best shown in FIG. 2 for example, and are received loosely between opposed inside surfaces 17' and 17'' of the flange 17.

Alternatively, the lock member 24 can be made of material which is not magnetizable in which event the plates 25' and 26' provide the requisite magnetizable material to assure sufficient magnetic responsiveness.

The entire underside of the planar portion 14 which covers the chamber 21 is provided with a ribbed or waffle-pattern reinforcement generally indicated at 39 having ribs **39*a* defining square pockets 39*b*. The generally planar portion 14 is also reinforced by a ridge 42 adjacent a through-hole 43. The planar portion 14 is rigid enough especially adjacent the lock 23 to prevent a would-be thief from defeating the lock 23 by deflecting the planar portion 14 downwardly, as shown in FIG. 2, which could cause the lock member 24 to deflect downwardly to unlock the lock 23. The wall portion 13 has a bulbous or dome-shaped projection 44 which serves as a guide or locator for the tag 10 with respect to the decoupler 33. The inside of the projection 44 is hollow except for a tubular guide 45 which defines an annular hole or recess 46 for receiving the free end portion of the shank 36 of the pin 34 with a minimum of clearance. It is thus not possible to wiggle the pin 34 so as to unlock it from the jaws 27 and 28. In the FIG. 2 position, the plates 25' and 26' are shown to contact the reinforcement 39 so that further upward flexure of the lock member 24 is not possible. The tag 10 is fastened to merchandise M by pushing the pointed shank 36 of the pin 34 through merchandise M, through the hole 43 and between the jaws 27 and 28 until the shank 36 extends into the recess 46. The jaws 27 and 28 can engage in any recess 37** depending upon the thickness of the material M.

The decoupler 33 (FIG. 3) includes a low carbon steel or iron, annular, cup-shaped member 47 for receiving the projection 44, contacting annular ceramic magnets 48 and 49, and low carbon steel or iron plates 50 and 51. Annular holes 52 and 53 in the magnets 48 and 49 have a larger inside diameter than the outside diameter of the member 47, and the space therebetween is filled with a suitable non-magnetic plastics material 54. When the tag 10 is positioned with its projection 44 in the blind hole 55 in the member 47, the magnetic forces exerted by the decoupler 33 deflect the lock member 24 into the position shown in FIG. 3, thereby releasing the shank 36 of the pin 34 from the jaws 27 and 28. The pin 34 can thus be removed as shown in the phantom line position in FIG. 3. As soon as the tag 10 is removed from the decoupler 33, the springs 29 and 30 return the lock member 24 to the FIG. 2 position.

The marker 22 provides a resonant RF circuit which can be detected in an interrogation zone of an electronic article surveillance systems of the type disclosed in U.S. Pat. No. 3,500,373 for example. The circuit includes a self-supporting winding or coil of the solenoid-type generally indicated at 56 and a capacitor 57. The coil or winding 56 defines a generally square opening or transverse area 58. The coil 56 is comprised of a single piece of copper wire wound into a generally square shape as shown. Opposite end portions 59 and 60 are turned inwardly into the winding opening 58. The capacitor 57 is soldered to the end portions 59 and 60 to complete the circuit. The area of the opening 58 is large compared to prior art resonant L-C circuits of the increasing spiral type. As is evident from the following equation $P=QA^{1.5}$, wherein P is the Performance Factor, Q is the circuit Q and A is the area of the winding opening 58, the Performance Factor increases by the area or winding opening to the 1.5 power. Thus, it is important in having good performance with a marker of reasonable size to configure the area as large as possible.

Figure 7:
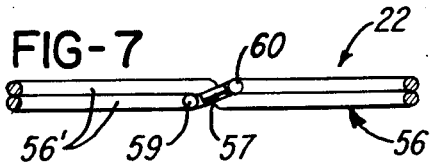
FIG. 7 is a sectional view taken along line 7—7 of FIG. 6.

In a specific embodiment of the invention, which is cited by way of example, not limitation, the wire 56' has a diameter of 1.45 millimeters and a thin insulative coating. The square winding opening 58 was about 43 millimeters on a side, it is preferred that the turns be spaced slightly (about 0.127 millimeter) even though they are shown in contact in FIG. 7. The marker 22 has a resonant frequency of 8.2 MegaHertz, the coil 56 has an inductance of 0.387 microHenries, the capacitor 57 has a capacitance of 1000 picoFarads, and the circuit Q is between 210 and 225. The Performance Factor is between $16.9\times10^6$ and $18.1\times10^6$. This Performance Factor is indicator of a highly satisfactory performance although markers with lesser or greater Performance Factors are useable as well. It has been found that in systems wherein the transmit and detector gates are three feet apart that P of $1\times10^6$ provides good performance. Thus the area (A) as well as the circuit Q (Q)can be less than in the specific embodiment and still provide a useable marker. It is to be noted that the lock 23 contains steel parts and as such is advantageously located outside the winding opening 58 so as not to have any appreciable affect on circuit performance. By way of further example, the winding opening is between 980 and 7500 square millimeters, the diameter of the winding is between 0.16 and 2.05 millimeters, the circuit Q is at least 25, and the Performance Factor is at least $1\times10^6$.

Other embodiments and modifications of the invention will suggest themselves to those skilled in the art, and all such of these as come within the spirit of this invention are included within its scope as best defined by the appended claims.

I claim:

1. A tag for use in an electronic article surveillance system, the tag comprising: a housing, a detectable marker held by the housing, a magnetic lock for holding the housing to an article to be protected, the housing including first and second wall portions, the lock including a pin having a head and a flexible, resilient, deflectable sheet metal member disposed between the spaced wall portions and having a pair of opposed jaws, the first wall portion being next adjacent the article to be protected and being sufficiently rigid at least adjacent the lock to prevent deflection of the sheet metal member from outside the housing without unlocking the magnetic lock, the jaws being movable to engage or disengage the pin selectively, the sheet metal member being biased so that the jaws engage the pin when the pin is received between the jaws, the jaws being positioned so that attempted withdrawal of the pin without prior movement of the jaws to the disengaged position will not release the pin, and the lock including magnetizable material adjacent the second wall portion to enable the jaws to be moved by magnetic attraction to a position disengaged from the pin.

2. A tag as defined in claim 1, wherein the sheet metal member includes a pair of plate portions having spaced side edges, and the plate portions being connected solely by a pair of leaf springs disposed between the side edges and outwardly of the jaws.

3. A tag as defined in claim 1, wherein the sheet metal member includes a pair of plate portions, each plate portion includes a flange, and each flange terminating at an edge in contact with the second wall portion.

4. A tag as defined in claim 1, wherein the sheet metal member includes a pair of plate portions, and an auxiliary plate composed of magnetizable material on each of the plate portions to enhance the magnetic response of the lock.

5. A tag as defined in claim 4, wherein the auxiliary plates are shaped generally the same as the plate portions.

6. A tag as defined in claim 1, wherein the first wall portion has a through-hole through which the pin can project, and wherein the second wall portion has means for providing a recess for receiving and stablizing the pin.

7. A tag as defined in claim 1, wherein the sheet metal member is of one-piece construction.

8. A tag as defined in claim 1, and a pair of plates on the sheet metal member, the plates being composed of magnetizable material.

* * * * *